United States Patent [19]

Latimer

[11] 4,347,675

[45] Sep. 7, 1982

[54] DREDGING MEANS HAVING MEANS FOR EXCLUDING OVERSIZED SLENDER OBJECTS

[75] Inventor: John P. Latimer, Newport News, Va.

[73] Assignee: Deepsea Ventures, Inc., Gloucester Point, Va.

[21] Appl. No.: 232,835

[22] Filed: Feb. 9, 1981

[51] Int. Cl.[3] ..... E02F 3/94; B07B 1/16; B01D 35/02; B07B 1/52

[52] U.S. Cl. ..... 37/57; 209/250; 209/660; 210/159; 37/DIG. 8

[58] Field of Search ..... 209/250, 262, 263-267, 209/356, 659, 660, 675; 299/8; 37/57, 58, DIG. 8; 408/152; 55/440; 210/158, 159, 162

[56] References Cited

U.S. PATENT DOCUMENTS

| | | | |
|---|---|---|---|
| 675,514 | 6/1901 | Lockhart | 299/8 |
| 853,603 | 5/1907 | Shepard | 209/356 |
| 867,984 | 10/1907 | Lake | 209/250 X |
| 979,412 | 12/1910 | Bergsman | 209/250 |
| 1,129,351 | 2/1915 | Lake | 299/8 |
| 1,652,878 | 12/1927 | Ruemelin | 209/264 |
| 1,731,115 | 10/1929 | Taylor | 209/264 X |
| 1,834,981 | 12/1931 | Stebbing | 55/440 X |
| 1,926,924 | 9/1933 | Sylvan | 55/440 |
| 2,579,282 | 12/1951 | Vicard | 55/440 X |
| 2,837,171 | 6/1958 | Kacher | 55/440 |
| 2,873,816 | 2/1959 | Umbricht | 55/440 X |
| 2,973,056 | 2/1961 | Sillers | 55/440 X |
| 2,976,954 | 3/1961 | Irwin | 55/440 X |
| 3,682,301 | 8/1972 | Ross | 209/675 |
| 4,171,581 | 10/1979 | Donaldson | 37/58 |

FOREIGN PATENT DOCUMENTS

| | | | |
|---|---|---|---|
| 364866 | 5/1921 | Fed. Rep. of Germany | 37/58 |
| 1075511 | 4/1954 | France | 209/250 |
| 685510 | 1/1953 | United Kingdom | 37/58 |

*Primary Examiner*—David L. Lacey
*Attorney, Agent, or Firm*—Barry G. Magidoff

[57] ABSTRACT

This invention provides dredging means having means to screen long slender particles wherein the long dimension extends in the direction of flow through a fluid-flow conduit. The screening means comprises a pair of opposing corrugated surfaces, the folds or corrugations on the opposing surfaces being substantially parallel, and separated by a distance, and having a wave length, determined by the size particle to be screened. Preferably, the corrugated surfaces are formed as a plurality of corrugated plates inserted within and extending along the direction of fluid-flow in a conduit. The axis of curvature of the corrugations or folds extend perpendicular to the flow of the stream.

17 Claims, 11 Drawing Figures

DREDGING MEANS HAVING MEANS FOR EXCLUDING OVERSIZED SLENDER OBJECTS

This invention is directed to means for dredging particles from the floor of a body of water, and especially protecting the dredging devices used for the mining of ocean floor nodule ores from the surface of the ocean floor, by limiting the intake of oversize particles.

With the recognition that terrestrial sources for raw materials, especially ores, are being swiftly depleted, effort has been made to obtain these valuable industrial raw materials from other sources, most especially the abyssal depths of the oceans. Such sources are generally to be found at depths of between 10,000 and 18,000 feet, requiring extremely deep water dredging means. The most valuable ores found to date are known as ocean floor nodule ores, or manganese nodules. These materials are often found as relatively small particulate forms, including fist-sized rocks or smaller pebbles or elongated pieces, or even as grains of sand. In addition to the ore particles, the ocean floor is also littered with the detritus of eons of ocean use by man as well as by the lower orders of animals, such as pieces of flotsam from man's manufactured ships, or the hard, durable, often fossilized, remains of dead animals, such as the bones of large fish or sea mammals.

A great deal of engineering effort has been undertaken to date to secure these ores and bring them to the surface for further processing.

The deposits of these valuable metal ores are often lying on the surface of the soft sea floors, in the form of fist-sized rocks, often partially immersed within a sediment layer on the ocean floor. The exact size of the ore pieces vary greatly, from relatively small pebbles or even sand-like grains, up to large rocks or even boulders. The smaller of such ore pieces can be directly secured by one form of mining machine designed to date, and that is the suction head dredge vehicle.

Such a suction-type dredging apparatus literally sucks the ore particles, much in the way of a vacuum cleaner, into the mining system, eventually transferring the thus collected particles via elevator means from the dredge vehicle to a surface vessel. The present preference is to carry the ore particles to the surface vessel entrained in liquid, especially sea water, and most especially in an airlift system.

When dredging for the valuable nodule ores at the bottom of the ocean, the ore gathering device should be as efficient and as durable as possible, in order to compensate for the great expense of collecting the ore from a location at least about 3 miles beneath the surface of the ocean. The suction effect of the nozzle has been made sufficiently great to be able to literally tear out the ore particles that are embedded within the silt and mud on the ocean floor. Of necessity, this results in the intake of not only the desired nodules, but also of the varied detritus mixed with the ore. That material that is the same size as the desired ore particles is picked up and carried through the dredge vehicle with no difficulty. The larger detritus as well as over-size ore particles have been screened out by conventional means, such as mesh work or parallel or otherwise placed rods over the intake to the nozzle. There can, however, be a problem with long slender pieces that could pass through the prior screening means if they are oriented along the longer axis. Once inside the system, they are capable of jamming the flow ducts, or even of causing serious damage to the system, for example, to a pump impeller on the dredge vehicle. This would necessitate halting dredging and perhaps bringing the dredge up to the surface for repairs.

In accordance with the present invention, means are provided to collect particulate solids from the bottom of a body of water, and more especially from the ocean floor, utilizing a negative pressure, or suction, to draw, e.g., the ore particles, into the collection system, and including specifically means to provide for the improved protection of the ore collection system by the screening of particles about all three dimensions. In particular, this invention includes an improved suction nozzle and dredge head assembly, adapted for gathering objects from the ocean floor, the assembly comprising a nozzle having a nozzle opening adjacent a first end thereof, the nozzle and dredge head assembly having interconnected internal surfaces defining a fluid flow conduit for the flow of fluids from the nozzle opening through the nozzle assembly and the dredge head assembly, and inlet means designed to provide a fluid-flow connection from the dredge head assembly to elevator means for carrying dredge material from the ocean floor to the ocean surface, the improvement comprising screening means suitable for excluding long slender objects, the screening means comprising a plurality of paired opposed corrugated surfaces within the fluid-flow conduit (each surface comprising folds), folded about axes transverse to the intended direction of fluid-flow through the conduit from the nozzle opening to the inlet, the plates defining a serpentine path for the fluid-flow and so separated as to prevent the passage of objects having a dimension along the direction of fluid-flow greater than a predetermined value. Preferably, the corrugated surfaces are provided by a plurality of corrugated plates, supported within the fluid-flow conduit, each plate being secured to the internal surface of the conduit and extending between two opposing sides of the conduit so as to divide the conduit into, preferably, several curved flow passages. Preferably, the corrugated surfaces are substantially parallel, the axes of the folds of the plates most preferably extending perpendicularly of the intended direction of fluid-flow, and optimally transversely to the long dimension of the cross-section of the conduit.

Most preferably, the corrugated surfaces are curvilinear wave forms, each surface comprising substantially at least about one complete cycle. In one preferred embodiment, the amplitude of the surface folds are such that any straight line drawn through the conduit extending in the direction of intended fluid flow and that is parallel to any portion of the corrugated surface must intersect a corrugated surface, or be tangent to an apex.

In a further preferred embodiment, release means are provided for the clearing of any particles captured by the corrugated screening means. Such release means include means to move the plates relative to a combing means, and/or to move the plates relative to one internal surface of the conduit.

A further understanding of the present invention can be obtained by reference to the preferred embodiments set forth in the illustrations of the accompanying drawings. The illustrated embodiments, however, are merely exemplary of certain presently known preferred means for carrying out the present invention. The drawings are not intended to limit the scope of this invention, but merely to clarify and exemplify, without being exclusive thereof.

Referring to the drawings.

Figure 1:
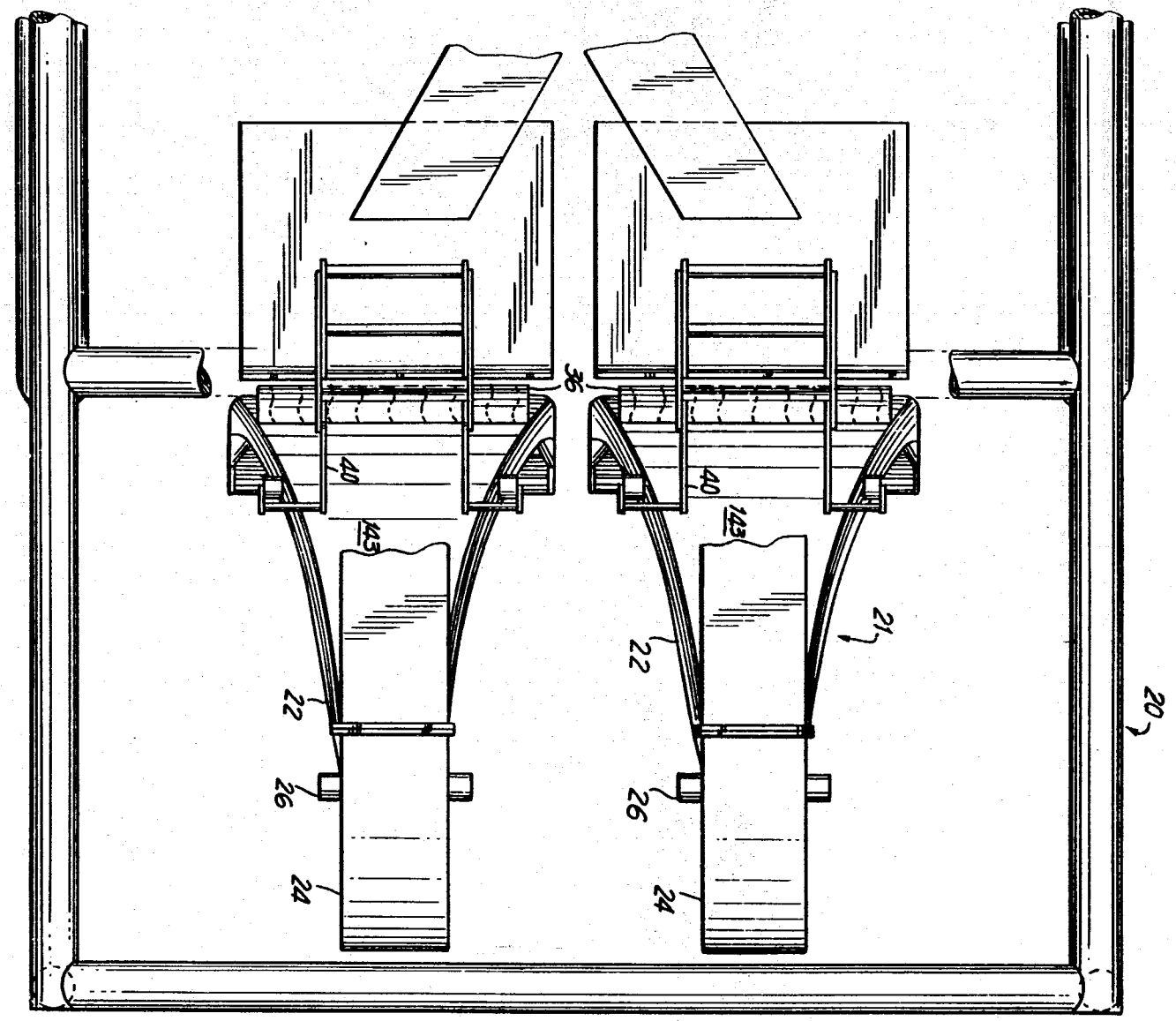
FIG. 1 is a rear elevation view of two dredge nozzle assemblies comprising the present invention on a dredge vehicle.

A dredge vehicle chassis comprising a plurality of intersecting vertical tubular members and horizontal tubular members, generally indicated by the numeral 20, supports a dredge assembly, including a nozzle assembly, generally indicated by the numeral 21. The vehicle is intended to ride along a pair of lower horizontal skid means, or runners, not shown, with a nozzle, generally indicated by the numeral 22, or in this case a plurality of nozzles 22, being supported such that the lower nozzle opening 30 is maintained adjacent the ocean floor during operation. The nozzle 22 is pivotally connected, and in fluid-flow connection, with a duct assembly 24, also supported from the dredge vehicle, the nozzle being pivotable about a pivot support, generally indicated by the numeral 26, i.e., about an axis substantially parallel to the surface upon which the dredge vehicle is supported and perpendicular to the forward direction of movement of the vehicle.

The internal surfaces of the nozzle 22 and of the duct 24 define a fluid-flow conduit, the conduit extending from the nozzle opening through the nozzle and through the duct 24 to a pump not shown. The connection between the nozzle 22 and the duct 24 at the pivoting point 26, is by a conventional seal, not shown. The nozzle can be structurally supported from the chassis by, for example, a conventional pillow block joint, or can be supported structurally directly from the duct 24. The pump is preferably of the suction type, which causes a large flow of water to be drawn into the nozzle opening together with the desired ore material to be dredged.

As shown in this embodiment, the nozzle 22 has a generally obliquely elongated forward surface 29 extending from the opening 30 of the nozzle, which is defined by vertical edges 31 and lateral edges 32. The nozzle 22 can be pivoted from the operating position shown in solid line in FIG. 2 to a raised position, indicated by the phantom lines in FIG. 2, by, for example, an hydraulic cylinder extending downwardly from a support on the upper part of the dredge chassis, to a portion of the rearward surface of the nozzle 22.

Figure 2:
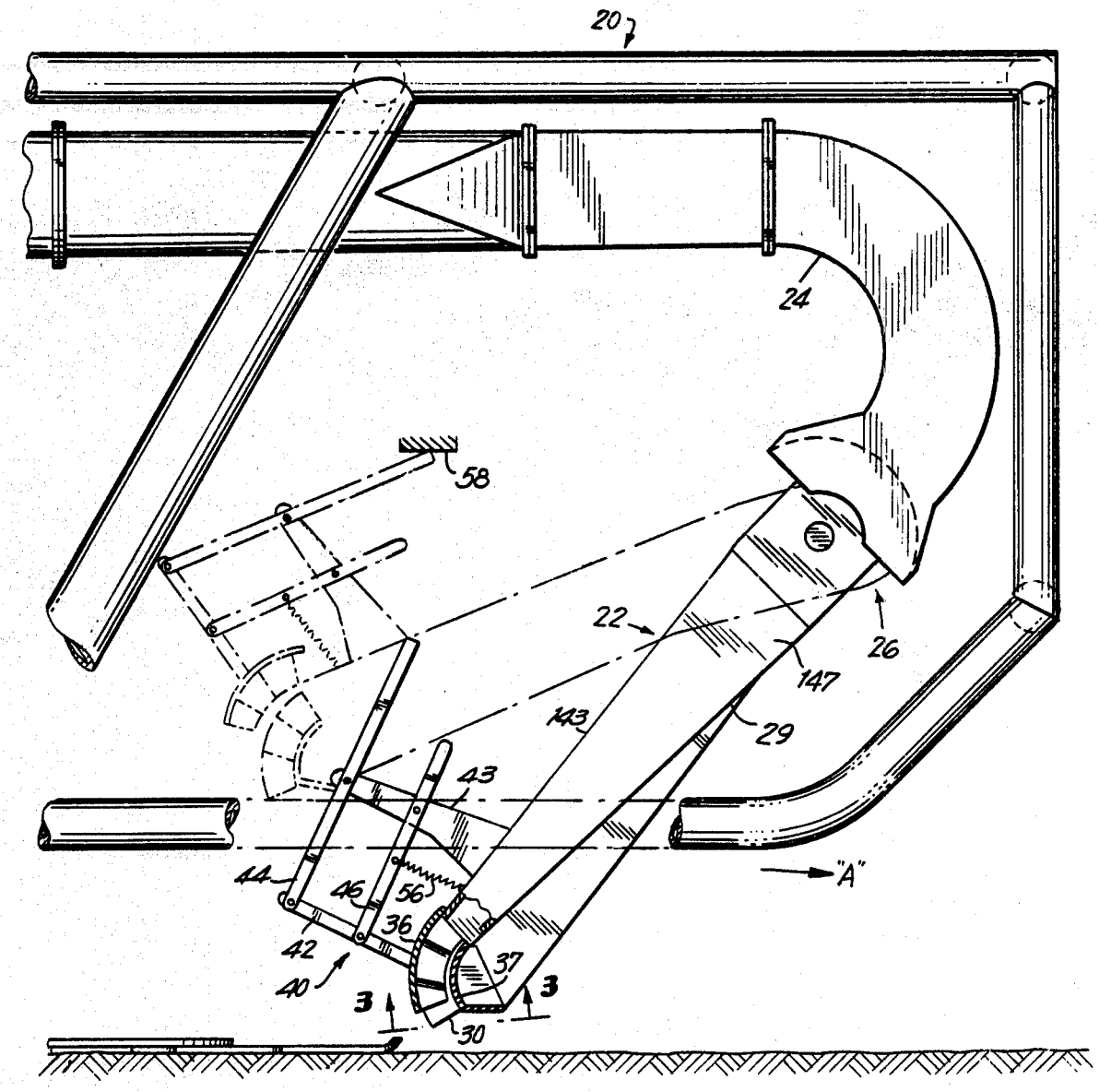
FIG. 2 is a side elevation of the assembly of FIG. 1.

The lower opening 30, to the nozzle, in the embodiment shown in FIGS. 1 and 2 is defined by a rearwardly movable nozzle end-piece 36 and the lower end of the nozzle front surface 37. The side walls forming the vertical edge 31 of the nozzle opening are rigidly secured to the rear end-piece 36. The nozzle opening is generally elongated in one direction, e.g., rectangular, as shown, or oblong, and the conduit leading to the pump has a generally similarly elongated transverse cross-section. Arrayed across the major dimension of the rear movable end-piece 36 is a row of substantially parallel corrugated plates 34, 35 each extending from the rear end-piece 36 substantially to the forward end 37, but rigidly secured along one edge to the rear end-piece 36. The corrugated, or folded, plates 34, 35, along the edges contacting the rear nozzle end-piece 36, extend longitudinally inwardly and upwardly into the conduit extending through the nozzle 22, such that the axes of the folds or corrugations of the plates 34, 35 extend transversely substantially perpendicularly to the internal surface of the end-piece 36.

The rear, curved, movable end-piece 36 is movable rearwardly and away from the forward end surface by the nozzle spreader mechanism, generally indicated by the numeral 40. The spreader mechanism 40 comprises a support plate 43 connected to and extending perpendicularly outwardly from the rear wall 143 of the nozzle 22. An intermediate portion of the support plate 43 is pivotally connected to a connecting rod 46, which is in turn pivotally connected at a first end to a rear end-piece tie rod 42. The tie rod 42 is secured at one end to the rear end-piece 36 and at the other end is pivotally connected to an opening lever 44. The opening lever 44 is in turn pivotally connected at an intermediate location to the outer end of the support plate 43. The outer end of the opening lever 44 is unsupported. A biasing spring 56 is secured to the connecting rod 46, intermediate the support plate 43 and the rearward tie rod 42, at one end, and to the rear nozzle wall 143 at its other end.

A tripping contact plate 58 is secured to the vehicle chassis 20.

Figure 11:
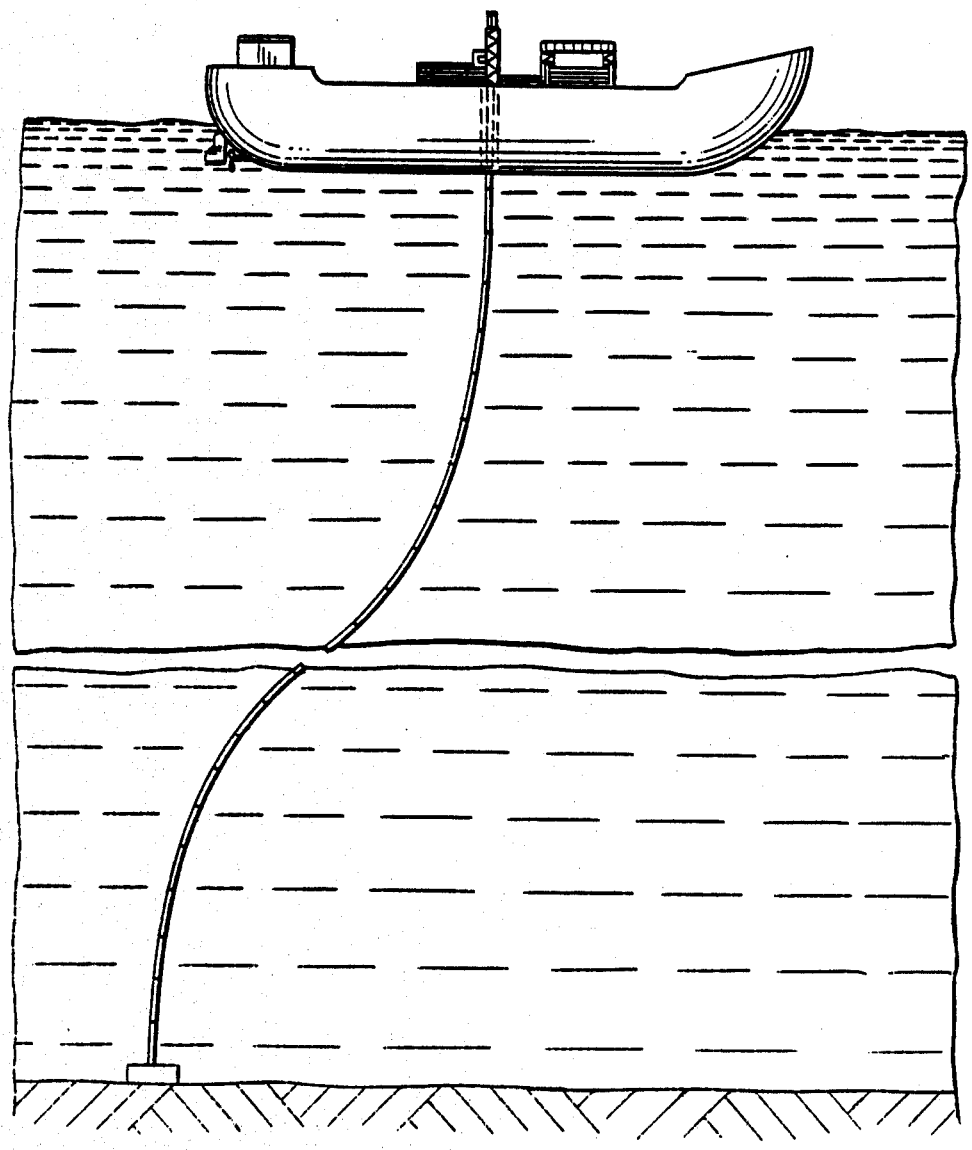
FIG. 11 is a diagram of a surface vessel towing a dredge vehicle of the type to include this invention.

In operation, the dredge can be moved forwardly, in the direction shown by the arrow "A" in FIG. 2 by, for example, a tow-line connected to a surface vessel, as shown in FIG. 11. The suction pump, located within the duct 24 downstream of the portion shown in FIG. 2, is activated to draw a stream of water into and through the nozzle opening 30, bringing into the nozzle together with the water the solid particles to be found on the ocean floor. The stream flows into the nozzle opening and through the curved flow channels formed by the corrugated plates 34, 35, within the nozzle conduit, then upwardly through the nozzle 22 and into and through the duct 24, to the pump impeller chamber.

In the event of a plug forming in the nozzle opening, for example by oversized particles, the plug being indicated by a substantial increase in pressure drop through the nozzle opening 30, the pump can be deactivated, and/or reversed so that either there is no suction into the nozzle opening or there is outward flow through the nozzle and out the nozzle opening.

The nozzle 22 can be raised by the hydraulic means, not shown, upwardly and rearwardly from the ocean floor surface until the free end of the operating lever 44 is depressed downwardly striking against the tripping plate 58. The lever 44 activates the spreader mechanism 40 to move the rear nozzle end-piece 36 rearwardly and upwardly away from the end of the forward nozzle surface 37, expanding the size of the nozzle opening. Any material jammed in the opening is released.

As soon as the jam is cleared, the nozzle 22 is lowered, moving the operating lever 44 from contact with the tripping contact plate 58, such that the biasing spring 56 draws the lower end of the connecting rod 46 towards the nozzle 22, thereby causing the rear curved nozzle end-piece 36, to come forward, towards the front surface as the nozzle drops down to the operating position. The pump can then be reactivated to once again continue the dredging operation.

The excluder means of this invention can also be located downstream from the nozzle opening 30, such as within the upper portion of the nozzle 22 or within the duct 24.

Figure 4:
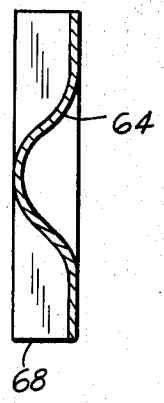
FIG. 4 is a section view of another embodiment.
Figure 5:
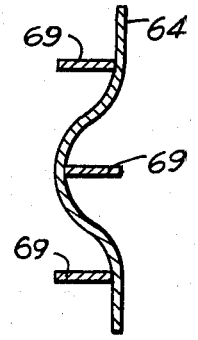
FIG. 5 is a further embodiment of the invention shown in FIG. 4.

In the embodiments shown in FIGS. 4 and 5, each of the corrugated plates 64 further comprises transverse elements which perpendicularly intersect each corrugated plate 66. The transverse elements can be one or more flat plates, as shown in FIG. 4, arranged at one or more levels along the height of the plate, or a plurality of thin, rod-like elements 69 extending laterally outwardly from each plate towards an adjacent plate 64. Preferably there are several located at each level of the plate (i.e., the same vertical distance from the end plate 36) and there are more than one row of the rods 69 (i.e., at different levels).

The perpendicular flat bars 68 and rods 69 intersecting the stationary corrugated plates 66, serve to prevent the passage of any vertically disposed slender material, i.e., one which is disposed perpendicular to the upper duct surface 28, and could thus move along the curved flow path between the adjoining corrugated plates 66, 64. The presence of these lateral elements 68, 69 serves to cut off such a vertically aligned slender rod and prevent its passage. A similar effect can be obtained by providing closely spaced, parallel rods immediately upstream from the corrugated plates, to prevent the passage of any vertically aligned slender particles.

Figure 3:
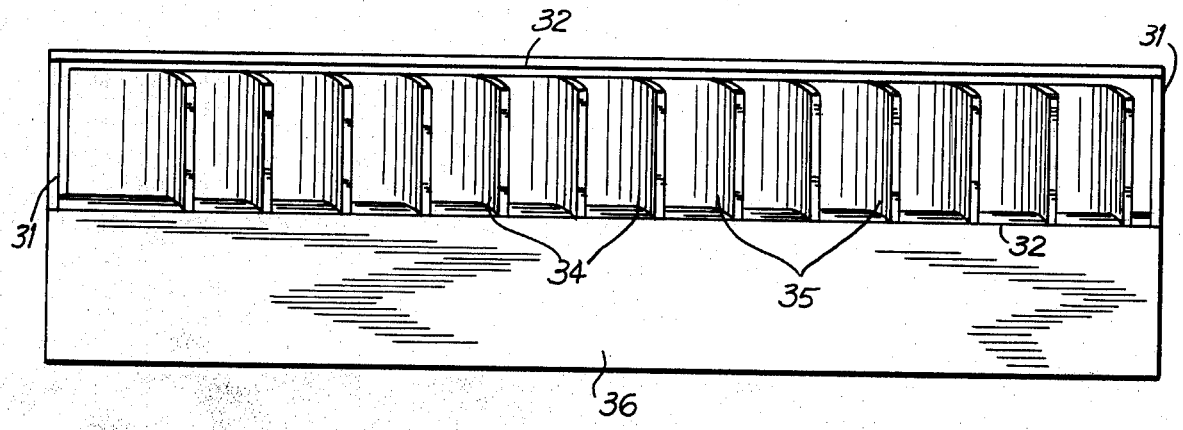
FIG. 3 is a view taken along lines 3—3 of FIG. 2.

Referring to FIGS. 6 through 9, a row of corrugated plates 73 are arrayed across the nozzle conduit adjacent the nozzle opening 30, much as in FIGS. 1 through 3. In this embodiment, the nozzle opening is defined by a substantially stationary, slotted wall 70 defining the rear wall of the nozzle opening 30 and a hinged and movable forward wall 71. The corrugated plates 73 are loosely fitted through the slots, defined by edges 75, through the stationary rearward wall 70. The spreader mechanism 40 is substantially similar to that shown in FIGS. 1 and 2, except that it is preferable that it provides for movement of the forward wall 71, as well. It is also more important that the plate 72 be drawn directly radially outwardly away from the slotted wall 70, to prevent jamming of the corrugated plates 73 against the edges of the slots 75. The forward wall 71 is preferably pivotable forwardly and upwardly about pivot pin 77, in this embodiment, in the event it is desired to release any oversized piece that may have been lodged in the immediate nozzle opening, i.e., upstream of the corrugated plates 73.

Figure 6:
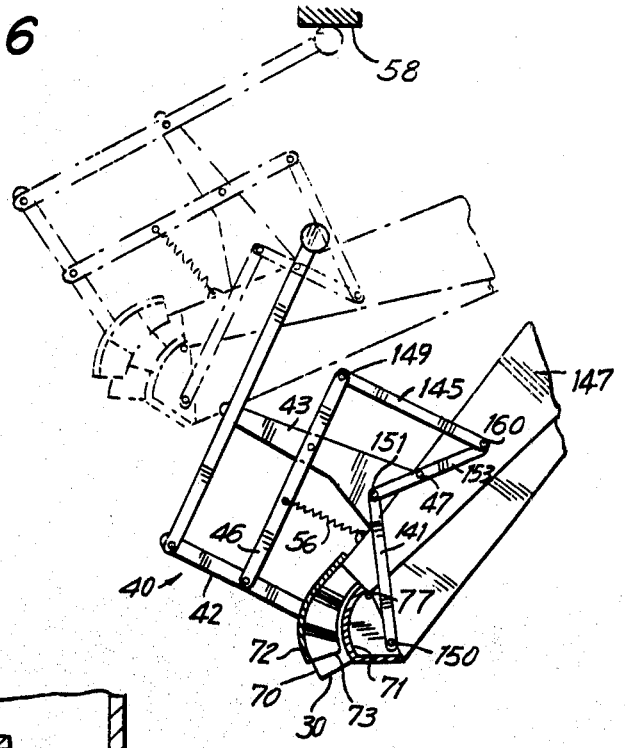
FIG. 6 is a further embodiment showing a portion of the dredge head assembly of FIG. 2.
Figure 8:
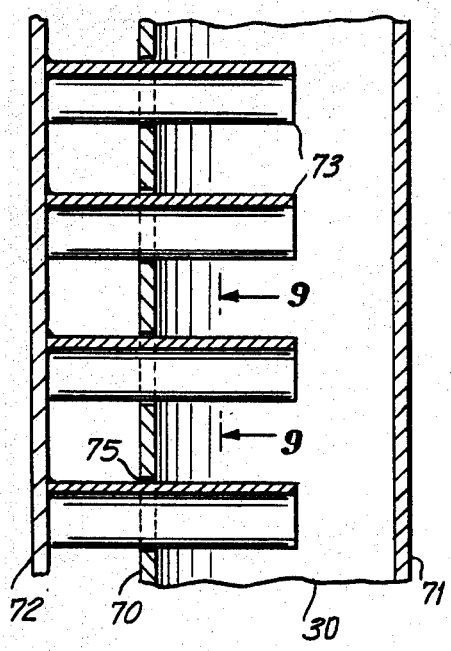
FIG. 8 is a section view along lines 8—8 of FIG. 7.
Figure 7:
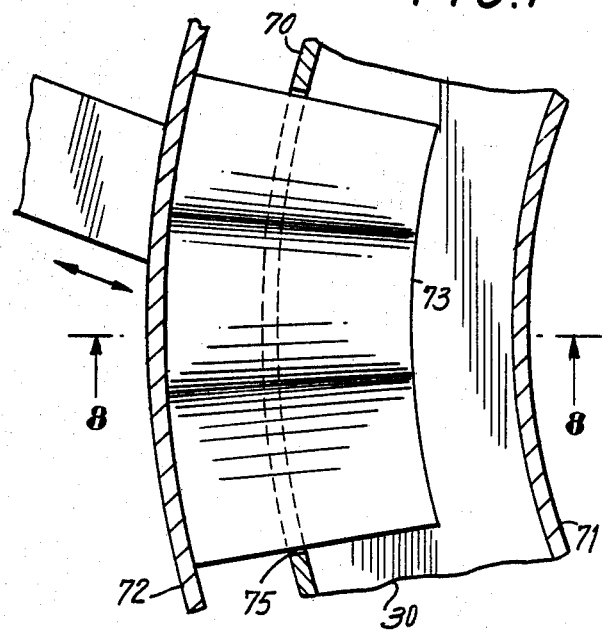
FIG. 7 is an expanded section of the lower portion of the nozzle of FIG. 6.
Figure 9:
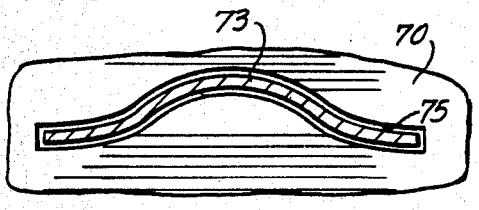
FIG. 9 is a section view along lines 9—9-of FIG. 8.

In the embodiment of FIG. 6, the spreader mechanism 40 comprises, in addition, a forward tie rod 141, pivotally connected by pin 150 at one end to the hinged, forward end wall 71, and pivotally connected at its second end by pin 151 to an angled tie rod 153, which is also pivotally supported at an intermediate location by the side of the nozzle 147, through pin joint 47. The second end of the angled tie rod 153 is pivotally connected by pin 160 to one end of an upper tie rod 145. The second end of the upper tie rod 145 is in turn pivotally connected to the second end of the connecting rod 46.

Any long slender pieces that are wedged between the corrugated plates 73 will be forced into the enlarged nozzle conduit as the corrugated plates 73 are drawn outwardly through the slots 75. The jammed piece would be ultimately pressed against the upper slotted wall 70, and pushed, or combed out, from between the plates 73 as the plates 73 reach the outer extreme of their movement.

Figure 10:
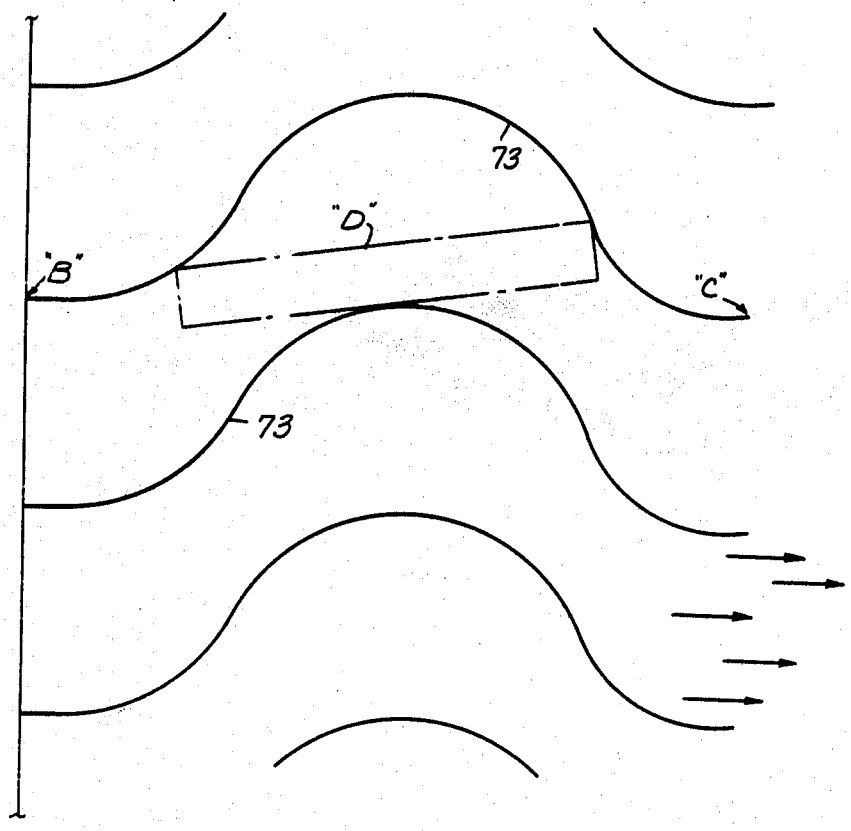
FIG. 10 is a diagrammatic sketch showing a long slender object caught in the screening means of this invention.

In accordance with the preferred embodiment of this invention, the pumping means on the dredge vehicle is of the centrifugal type, comprising a centrifugal impeller rotating at extremely high rotational velocities. It is desirable to prevent the intake of a long, rigid slender object into the impeller chamber in order to prevent damage to the impeller assembly. Accordingly, it is generally desirable that the corrugated plates be so arranged, and have a wave amplitude of such size, that they are able to screen out any objects having major dimensions sufficiently large to cause damage to the pump impeller, or that could create obstruction in any of the pipe systems leading from the dredge to the surface, e.g., any suction pipe or air-lift pipe. The specific maximum size to be removed from the system is therefore dependant upon the pump geometry of any impeller chamber or air-lift system, or other flow system, being used downstream of the dredge head. Once the maximum size particle that can safely be passed is determined, the spacing of the corrugated plates, and the radius of curvature of the corrugations are determined by graphical or empirical methods, e.g., as shown in FIG. 10. In any event, the spacing of the plates must be sufficient to pass the desired maximum size particle having a compact configuration.

For example, referring to the curved corrugated plates 73 diagrammatically shown in FIG. 10, an elongated foreign particle D, having a major dimension of $5\frac{1}{2}$ inches and a minor dimension of $\frac{3}{4}$ inch, can be trapped by plates that are separated by $2\frac{3}{4}$ inches. Each plate defines at least one complete cycle of a regular sinusoidal curve, i.e., from the upstream end, point "B", to the downstream end of each plate, point "C", with flow moving in the direction indicated by the arrows. The total amplitude of each curve, i.e., the distance between the peak and the trough equal to about $2\frac{3}{4}$ ins., the separation distance of the plates. All of the plates are substantially concentric.

As shown, the corrugated plates are curved throughout their length. Alternatively, there can be used plates that are angularly bent, wherein the apex comes to a substantially sharp point, or that form an irregular or discontinuous curve. This is less desirable, however, because of greater turbulence created in the flow passage.

Referring to the diagram of FIG. 10, one complete curve cycle is formed between the flow tangent point at the beginning of the curved plate, indicated by the initial "B" and the flow tangent point at the end of the plate, indicated by the initial "C". In FIG. 10, each plate is shown as a regular curve, substantially sinusoidal and extending over 360° of rotation. Any other shape of curve or fold can be used that provides for alternating concave/convex surfaces. The facing surfaces of adjacent corrugated plates are preferably substantially parallel, or concentric.

The present invention, therefore, goes a step beyond the traditional screening means, such as a mesh, or spaced parallel rods, which exclude objects that are oversize in directions transverse to the flow through the nozzle inlet. This invention excludes objects where the oversize dimension is parallel to the direction of flow. It is thus desirable that a preliminary, conventional screen, such as a mesh or closely spaced parallel rods, be present at the mouth of the nozzle, upstream from the corrugated plates.

Each corrugated plate is preferably rigid, formed of a material such as a metal or a rigid plastic.

The patentable embodiments of this invention which are claimed are as follows:

1. Screening means for screening long slender particles to prevent passage through a fluid-flow conduit, wherein the particles have their long dimension extending along the longitudinal axis of the flow conduit, the screening means comprising a conduit and a plurality of opposed pairs of corrugated surfaces within the conduit, the axes of the folds extending transversely to, and the corrugated surfaces being folded along, the direction of fluid-flow through the conduit, such that the corrugated surfaces define a plurality of separate serpentine flow channels through the conduit, and transverse members extending transversely along each serpentine flow channel, extending between and intersecting the opposed corrugated surfaces, intermediate the interior periphery of the conduit.

2. The screening means of claim 1 wherein the axes of the folds are substantially perpendicular to the longitudinal axis of the flow conduit.

3. The screening means of claim 2 wherein the opposed corrugated surfaces are substantially parallel.

4. The screening means of claim 1 wherein the conduit has a cross-section perpendicular to the longitudinal axis of the flow conduit having a minor dimension and a major dimension, the fold axes extend along the minor dimension.

5. The screening means of claim 4 wherein each corrugated surface comprises substantially one complete curve cycle.

6. The screening means of claim 2, 4 or 3 wherein the surfaces of the corrugations comprise substantially continuous curved surfaces.

7. The screening means of claim 1, wherein the corrugated surfaces are formed on a plurality of spaced corrugated plates secured to and supported within the conduit.

8. The screening means of claim 1 wherein the corrugated surfaces are formed on a plurality of spaced corrugated plates secured to and supported within the conduit, and cleaning members extending transversely of the axes of fold of, and located intermediate the adjacent corrugated plates; and means to move the corrugated plates relative to the cleaning members in a directon along the fold axes, whereby material jammed between any pair of adjacent corrugated plates is pushed out.

9. In a dredge means for collecting particles from the floor of the ocean, the particles entering the dredge means together with a large volume of water, the dredge means comprising: a nozzle having a nozzle inlet designed to be located adjacent to the ocean floor; liquid pumping means for drawing a flow of liquid with suspended solids into and through the nozzle inlet; and conduit means, the nozzle and conduit means defining an internal flow channel between the nozzle opening and the pumping means; the improvement comprising screening means suitable for excluding long slender objects from passing through the flow channel, the screening means comprising a plurality of pairs of opposed corrugated surfaces within a portion of the flow channel, the corrugated surfaces being folded about axes transverse to the longitudinal axis of the flow channel from the nozzle inlet to the pump, each pair of opposed corrugated surfaces defining a separate serpentine conduit for liquid flow within the flow channel and being spaced apart by a distance designed to prevent the passage of the slender objects having a dimension measured along the longitudinal axis of the flow channel which is greater than a predetermined value.

10. The dredge means of claim 9 wherein the corrugated surfaces are formed on a plurality of spaced corrugated plates secured to and supported within the flow channel.

11. The dredge means of claim 10 comprising internal walls defining the flow channel, at least a portion of one internal wall being relatively movable, the plurality of corrugated plates being secured to the relatively movable internal wall.

12. The dredge means of claim 9 or 10 or 11 wherein the axes of the folds on the corrugated surfaces extends substantially perpendicularly to the longitudinal axis of the flow channel.

13. The dredge means of claim 12 wherein the relationship between the amplitudes of the corrugations on the opposed corrugated surfaces and the distance between the corrugated surfaces are such that a straight line, that is parallel to any portion of a corrugated surface drawn through the portion of the flow channel, must intersect at least a portion of one corrugated surface.

14. The dredge means of claim 11 wherein the corrugated surfaces comprise curvilinear wave forms, each surface comprising substantially at least about one complete wave cycle.

15. The dredge means of claim 11 wherein the corrugated plates are located adjacent the nozzle inlet.

16. The dredge means of claim 9 comprising in addition transverse members extending transversely across each serpentine conduit, extending between and intersecting the opposed corrugated surfaces.

17. In a dredge means for collecting particles from the floor of the ocean, the particles entering the dredge means together with a large volume of water, the dredge means comprising: a nozzle having a nozzle inlet designed to be located adjacent to the ocean floor; liquid pumping means for drawing a flow of liquid with suspended solids into and through the nozzle inlet; and conduit means, the nozzle and conduit means defining an internal flow channel between the nozzle opening and the pumping means; the improvement comprising screening means suitable for excluding long slender objects from passing through the flow channel, the screening means comprising a plurality of spaced corrugated plates secured to and supported within a portion of the flow channel, there being formed on each pair of adjacent plates a pair of opposed corrugated surfaces, the corrugated surfaces being folded about axes transverse to the longitudinal axis of the flow channel from the nozzle inlet to the pump, each pair of opposed corrugated surfaces defining a separate serpentine conduit for fluid flow within the flow channel and being spaced apart by a distance designed to prevent the passage of objects having a dimension along the longitudinal axis of the flow channel greater than a predetermined value; cleaning members extending transverse of the axes of fold of, and located intermediate the, adjacent corrugated plates; and means to move the corrugated plates relative to the cleaning members along the fold axes, whereby material jammed between any pair of adjacent corrugated plates is pushed out.

* * * * *